US008449357B2

(12) United States Patent
Sung

(10) Patent No.: US 8,449,357 B2
(45) Date of Patent: May 28, 2013

(54) POLYMERIC FIBER CMP PAD AND ASSOCIATED METHODS

(76) Inventor: Chien-Min Sung, Tansui (TW)

( * ) Notice: Subject to any disclaimer, the term of this patent is extended or adjusted under 35 U.S.C. 154(b) by 1269 days.

(21) Appl. No.: 12/246,253

(22) Filed: Oct. 6, 2008

(65) Prior Publication Data

US 2009/0098814 A1 Apr. 16, 2009

Related U.S. Application Data

(60) Provisional application No. 60/977,969, filed on Oct. 5, 2007.

(51) Int. Cl.
*B24D 11/00* (2006.01)

(52) U.S. Cl.
USPC ..... 451/532; 451/527

(58) Field of Classification Search
USPC ..... 451/532, 526, 527; 51/298, 299
See application file for complete search history.

(56) References Cited

U.S. PATENT DOCUMENTS

| | | | | |
|---|---|---|---|---|
| 4,728,552 | A | 3/1988 | Jensen, Jr. | |
| 5,609,517 | A * | 3/1997 | Lofaro | 451/529 |
| 5,944,589 | A * | 8/1999 | Nakajima | 451/285 |
| 6,454,633 | B1 | 9/2002 | Reinhardt et al. | |
| 6,962,524 | B2 * | 11/2005 | Butterfield et al. | 451/526 |
| 6,964,604 | B2 * | 11/2005 | Chen et al. | 451/532 |
| 7,025,668 | B2 * | 4/2006 | Petroski et al. | 451/526 |
| 7,086,932 | B2 | 8/2006 | Vangsness et al. | |
| 7,118,461 | B2 | 10/2006 | West et al. | |
| 7,186,166 | B2 | 3/2007 | Chen et al. | |
| 7,207,878 | B2 | 4/2007 | Hu et al. | |

* cited by examiner

*Primary Examiner* — Dung Van Nguyen
(74) *Attorney, Agent, or Firm* — Thorpe North & Western LLP

(57) ABSTRACT

Polishing tools and their methods of manufacture and use are disclosed. In one aspect, a polishing device is provided, including a plurality of polymeric fibers longitudinally arranged and embedded in a polymeric binder, the polymeric binder having a stiffness that is less than a stiffness of the polymeric fibers, and a working end of the plurality of polymeric fibers configured such that tips of the polymeric fibers are oriented to contact a work piece.

16 Claims, 2 Drawing Sheets

POLYMERIC FIBER CMP PAD AND ASSOCIATED METHODS

PRIORITY DATA

This application claims the benefit of U.S. Provisional Patent Application Ser. No. 60/977,969, filed on Oct. 5, 2007, which is incorporated herein by reference.

FIELD OF THE INVENTION

The present invention relates generally to polymeric fiber tools and associated methods. Accordingly, the present invention involves the chemical and material science fields.

BACKGROUND OF THE INVENTION

Many industries utilize a chemical mechanical polishing (CMP) process for polishing certain work pieces. Particularly, the computer manufacturing industry relies heavily on CMP processes for polishing wafers of ceramics, silicon, glass, quartz, and metals. Such polishing processes generally entail applying the wafer against a rotating pad made from a durable organic substance such as polyurethane. A chemical slurry is utilized that contains a chemical capable of breaking down the wafer substance and an amount of abrasive particles which act to physically erode the wafer surface. The slurry is continually added to the rotating CMP pad, and the dual chemical and mechanical forces exerted on the wafer cause it to be polished in a desired manner.

Of particular importance to the quality of polishing achieved is the distribution of the abrasive particles throughout the pad. The top of the pad holds the particles by means of fibers or small pores, which provide a friction force sufficient to prevent the particles from being thrown off of the pad due to the centrifugal force exerted by the pad's spinning motion. Therefore, it is important to keep the top of the pad as flexible as possible, to keep the fibers as erect as possible, and to assure that there is an abundance of open pores available to receive newly applied abrasive particles.

One problem that arises with regard to maintaining the pad surface, however, is an accumulation of polishing debris coming from the work piece, the abrasive slurry, and the pad dresser. This accumulation causes a "glazing" or hardening of the top of the pad, mats the fibers down, and thus makes the pad surface less able to hold the abrasive particles of the slurry. These effects significantly decrease the pad's overall polishing performance. Further, with many pads, the pores used to hold the slurry, become clogged, and the overall asperity of the pad's polishing surface becomes depressed and matted. A CMP pad dresser can be used to revive the pad surface by "combing" or "cutting" it. This process is known as "dressing" or "conditioning" the CMP pad. Many types of devices and processes have been used for this purpose. One such device is a disk with a plurality of superhard crystalline particles such as diamond particles attached to a metal-matrix surface.

Ultra-large-scale integration (ULSI) is a technology that places at least 1 million circuit elements on a single semiconductor chip. In addition to the tremendous density issues that already exist, with the current movement toward size reduction, ULSI has become even more delicate, both in size and materials than ever before. Therefore, the CMP industry has been required to respond by providing polishing materials and techniques that accommodate these advances. For example, lower CMP polishing pressures, smaller size abrasive particles in the slurry, and polishing pads of a size and nature that do not over polish the wafer must be used. Furthermore, pad dressers that cut asperities in the pad which can accommodate the smaller abrasive particles, and that do not overdress the pad must be used.

There are a number of problems in attempting to provide such a pad dresser. First, the superabrasive particles must be significantly smaller than those typically used in currently know dressing operations. Generally speaking, the superabrasive particles are so small that a traditional metal matrix is often unsuitable for holding and retaining them. Further, the smaller size of the superabrasive particles, means that the particle tip height must be precisely leveled in order to uniformly dress the pad. Traditional CMP pad dressers can have particle tip height variations of more than 50 μm without compromising dressing performance. However, such a variation would render a dresser useless if it were required to dress a CMP pad and achieve a uniform asperity depth of 20 μm or less, for example.

In addition to issues with properly holding very small superabrasive particles, the tendencies of metal to warp and buckle during a heating process, cause additional issues in obtaining a CMP pad dresser having superabrasive particle tips leveled to within a narrow tolerance range. While other substrate materials such as polymeric resins have been know, such materials typically are not able to retain superabrasive particles to a degree that is sufficient for CMP pad dressing.

SUMMARY OF THE INVENTION

Accordingly, the present invention provides tools and methods that are, without limitation, suitable to polish the delicate applications as recited above. In one aspect, a CMP polishing device is provided, including a plurality of polymeric fibers longitudinally arranged and embedded in a polymeric binder, the polymeric binder having a Young's Modulus that is less than a Young's Modulus of the polymeric fibers, and a working end of the plurality of polymeric fibers configured such that tips of the polymeric fibers are oriented to contact a work piece. In another aspect, a polishing device is provided, including a plurality of polymeric fibers longitudinally arranged in a polymeric binder, the polymeric binder having a stiffness that is less than a stiffness of the polymeric fibers, and a working end of the plurality of polymeric fibers configured such that tips of the polymeric fibers are oriented to contact a work piece.

A variety of configurations of polymeric fibers and arrangements of polymeric fibers are contemplated, and such configurations may be variable depending on the intended use of the device and the nature of the work piece being polished. In one aspect, for example, the polymeric fibers may be arranged in the polymeric binder with a center-to-center spacing of from about 2 times the diameter of the polymeric fibers to about 10 times the diameter of the polymeric fibers. In another aspect, the polymeric fibers may be arranged in the polymeric binder with a center-to-center spacing from about 3 times the diameter of the polymeric fibers to about 8 times the diameter of the polymeric fibers. In yet another aspect, the polymeric fibers may be arranged in the polymeric binder with a center-to-center spacing of from about 4 times the diameter of the polymeric fibers to about 6 times the diameter of the polymeric fibers. Additionally, in one aspect the polymeric fibers may have a diameter of from about 2 microns to about 50 microns. In another aspect, the polymeric fibers may have a diameter of from about 5 microns to about 20 microns. In yet another example, the polymeric fibers may have a diameter of from about 8 microns to about 15 microns.

Additionally, a variety of materials may be used to construct the polymeric fibers. The selection of such materials may vary according to numerous factors, such as the nature of the polymeric binder, the polishing environment, the work piece, etc. For example, in one aspect, the polymeric fibers made be made from non-limiting examples of materials such as polyphenols, polyurethanes, polyamides, aromatic polyamides, polycarbamides, polycarbonates, polyimides, polyphenylene sulfides, polyesters, epoxies, celluloses, polyvinylchlorides, polyvinyl alcohols, nylons, polypropylenes, acrylics, polyethylenes, and combinations and copolymers thereof. In one specific example, the polymeric fibers may be made from a nylon material.

In some aspects of the present invention, the polymeric fibers may be impregnated with nano-abrasive particles. Non-limiting examples of such nano-abrasives may include diamond, cBN, SiC, $Al_2O_3$, $CeO_2$, $MnO_2$, $ZrO_2$, granet, $SiO_2$, glass, $Fe_2O_3$, $Si_3N_4$, $B_4C$, carbon nano tubes, Bucky balls, and combinations thereof. One specific example of such nano-abrasive particles may include nanodiamond particles.

As has been described, the polymeric binders of the present application have a stiffness that is less than the stiffness of the plurality of polymeric fibers. As such, any polymeric binder may be utilized, provided the stiffness of such a binder is less than the stiffness of the polymeric fibers being secured therein. Non-limiting examples of such polymeric binders may include polyethylenes, polyvinyl chlorides, polyvinyl fluorides, polyphenols, polypropylenes, polystyrenes, acrylics, polyurethanes, polyether urethanes, polyester, polycarbonates, polysilicones, polyacrylates, polymethelmethacrylate, polyaramides, celluloses, epoxies, polybutadienes, polyisoprenes, polychloroprenes, isobutenes, and combinations and copolymers thereof. In one specific aspect, the polymeric binder includes a polyphenol.

The present invention additionally provides methods of making polymeric CMP devices. In one aspect such a method may include selecting a plurality of polymeric fibers having a diameter corresponding to a desired contact pressure, arranging the plurality of polymeric fibers longitudinally such that an average spacing between individual polymeric fibers corresponds to a desired polishing rate, impregnating the plurality of polymeric fibers with an uncured polymeric binder, curing the polymeric binder to secure together the polymeric fibers, and truing a surface of the plurality of polymeric fibers perpendicular to the axis of the polymeric fibers.

Furthermore, the present invention additionally provides methods of using a polymeric fiber CMP device. Such a method may include contacting tips of a plurality of longitudinally arranged polymeric fibers against a work piece, where the plurality of polymeric fibers have an average parallel spacing corresponding to a desired polishing rate. The method may further include moving the plurality of longitudinally arranged polymeric fibers tangentially across a polishing surface of the work piece such that only the tips of the polymeric fibers contact the polishing surface.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

Figure 1:
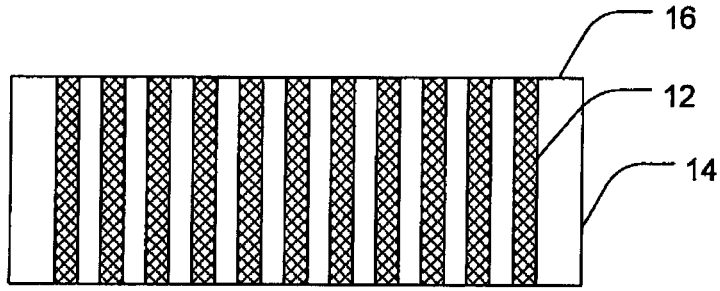
FIG. 1 is a cross-sectional view of a polishing device in accordance with one embodiment of the present invention.

In describing and claiming the present invention, the following terminology will be used in accordance with the definitions set forth below.

The singular forms "a," "an," and, "the" include plural referents unless the context clearly dictates otherwise. Thus, for example, reference to "a fiber" includes reference to one or more of such fibers, and reference to "the resin" includes reference to one or more of such resins.

As used herein, "superhard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "particle" refers to a particulate form of a material. Such particles may take a variety of shapes, including round, oblong, square, euhedral, etc., as well as a number of specific mesh sizes. As is known in the art, "mesh" refers to the number of holes per unit area as in the case of U.S. meshes. As used herein, "nano-abrasive" refers to abrasive particles having a size in the nano-range. Size ranges may vary depending on the particular use. In one aspect, however, nano-abrasives may range in size from about 1000 nm to about 1 nm. In another aspect, nano-abrasives may range in size from about 100 nm to about 10 nm. In yet another aspect, nano-abrasives may range in size from about 50 nm to about 20 nm. Such nano-particles may take a variety of shapes, including round, oblong, square, euhedral, etc., and they may be single crystal or polycrystalline.

As used herein, "Young's Modulus" refers to a quantification of the stiffness of a given material. Young's modulus, E, can be calculated by dividing the tensile stress by the tensile strain, as is shown in Formula I:

$$E = \frac{\text{tensile_stress}}{\text{tensile_strain}} = \frac{\sigma}{\varepsilon} = \frac{F/A_0}{\Delta L/L_0} = \frac{FL_0}{A_0 \Delta L} \quad \text{(I)}$$

where

E is the Young's modulus (modulus of elasticity) measured in pascals;

F is the force applied to the object;

A0 is the original cross-sectional area through which the force is applied;

ΔL is the amount by which the length of the object changes;

L0 is the original length of the object.

As used herein, "ceramic" refers to a hard, often crystalline, substantially heat and corrosion resistant material which may be made by firing a non-metallic material, sometimes with a metallic material. A number of oxide, nitride, and carbide materials considered to be ceramic are well known in the art, including without limitation, aluminum oxides, silicon oxides, boron nitrides, silicon nitrides, and silicon carbides, tungsten carbides, etc.

As used herein, "grid" means a pattern of lines forming multiple squares.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The Invention

The present invention provides polishing tools constructed of polymeric fibers and associated methods of making and use. Though much of the following discussion relates to chemical mechanical polishing (CMP) pads, it should be understood that the methods and tools of the presently claimed invention are equally applicable to any tool utilized to polish a work piece, all of which are considered to be within the scope of the present invention. The inventor has discovered that a beneficial polishing device may be created using a plurality of polymeric fibers secured in a polymeric binder. By fixing a plurality of polymeric fibers longitudinally in a pattern, a polishing device may be constructed that may be used to polish even very delicate work piece materials. Using polymeric fibers as polishing elements avoids many of the prior problems associated with superabrasive particles, such as particle retention, particle size and shape uniformity, uniformity of the working surface of the tool, etc.

Figure 2:
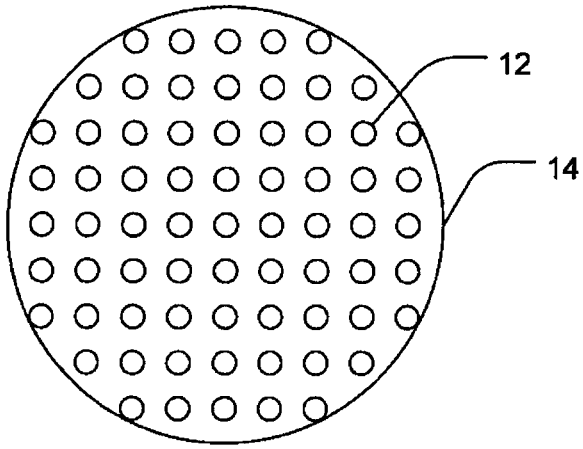
FIG. 2 is a perspective view of a polishing device in accordance with one embodiment of the present invention.

As such, in one embodiment a CMP device may include a plurality of polymeric fibers longitudinally arranged and embedded in a polymeric binder, the polymeric binder having a stiffness that is less than a stiffness of the polymeric fibers, and a working end of the plurality of polymeric fibers configured such that tips of the polymeric fibers are oriented to contact a work piece. One example of such an arrangement is shown in FIG. 1. A plurality of polymeric fibers 12 is shown embedded in a polymeric binder 14. The polymeric binder 14 secures the polymeric fibers 12 into a particular pattern for polishing. A working end 16 of the device may be trued to expose the tips of the plurality of polymeric fibers 12. Thus a work piece may be polished by positioning the working end 16 of the device against, and moving the device relative to, the work piece. FIG. 2 shows a top view of a polishing device having a plurality of polymeric fibers 12 embedded in a polymeric binder 14. The polymeric fibers indicted at 12 may represent single fibers, or they may represent bundles of fibers, as is more fully described herein.

Numerous configurations of polymeric fibers in the polymeric binder are contemplated, provided that the tips of the polymeric fibers contact the work piece during polishing. If the polymeric fibers protrude too far from the polymeric binder, the polymeric fibers may fold during polishing and potentially cause damage to the work piece or interfere with the polishing action of the neighboring fibers. The allowable distance for protrusion of the polymeric fibers from the polymeric binder will depend on the characteristics of the fibers and the binder, the polishing conditions being utilized, the nature of the work piece, etc. In one aspect, however, the tips of the polymeric fibers may protrude from the polymeric binder at the working end to a distance of less than about 20 microns. In another aspect, the tips of the polymeric fibers may protrude from the polymeric binder at the working end to a distance of less than about 10 microns. In yet another aspect, the tips of the polymeric fibers may protrude from the polymeric binder at the working end to a distance of less than about 5 microns. In a further example, the tips of the polymeric fibers may protrude from the polymeric binder at the working end to a distance of less than about 1 micron. It is also contemplated that the tips of the polymeric fibers may be positioned flush with the polymeric binder at the working surface.

In addition to protrusion, the spacing between the polymeric fibers can have a significant impact on the polishing characteristics of the polishing tool. For example, the rate of polishing is dependent on the spacing between the fibers. So to achieve a specific polishing rate, a device may be constructed having polymeric fibers spaced at a distance corresponding to the desired polishing rate. The range of allowable spacing will also be constrained by the diameter of the polymeric fibers, as is further discussed herein. Accordingly, it should be understood that the spacing between the fibers may vary depending on the desired polishing rate of the device. In one aspect, for example, the polymeric fibers may be arranged in the polymeric binder with a center-to-center spacing of less than or equal to about 50 microns. In another aspect, the polymeric fibers may be arranged in the polymeric binder with a center-to-center spacing of from about 10 microns to about 100 microns. In yet another aspect, the polymeric fibers may be arranged in the polymeric binder with a center-to-center spacing of from about 20 microns to about 50 microns. The polymeric fibers may also be arranged in the polymeric binder with a spacing that is dependent on the diameter of the polymeric fibers. In one aspect, for example, the polymeric fibers may be arranged in the polymeric binder with a center-to-center spacing of from about 2 times the diameter of the polymeric fibers to about 10 times the diameter of the polymeric fibers. In another aspect, the polymeric fibers may be arranged in the polymeric binder with a center-to-center spacing from about 3 times the diameter of the polymeric fibers to about 8 times the diameter of the polymeric fibers. In yet another aspect, the polymeric fibers may be arranged in the polymeric binder with a center-to-center spacing of from about 4 times the diameter of the polymeric fibers to about 6 times the diameter of the polymeric fibers.

Furthermore, the diameter of the polymeric fibers can also have a significant impact on the polishing characteristics of the tool. For example, the contact pressure of the tip of a fiber against the work piece is dependent on a variety of factors, such as the stiffness and the diameter of the fiber. So to achieve a specific contact pressure, a device may be constructed having polymeric fibers having a diameter corresponding to the desired contact pressure. The possible ranges of fiber diameters available may be constrained to some degree by the stiffness and the spacing of the fibers in the tool. For example, polymeric fibers made from very stiff polymeric materials may be made with a smaller diameter as compared to a polymeric material that is less stiff, due to potential polishing failure of these latter fibers at smaller diameters. In one aspect, for example, the polymeric fibers may have a diameter of from about 2 microns to about 50 microns. In another aspect, the polymeric fibers may have a diameter of from about 5 microns to about 20 microns. In yet another example, the polymeric fibers may have a diameter of from about 8 microns to about 15 microns.

In addition to the diameter of the polymeric fibers, the relative stiffness between the fibers and the binder may play an important role in generating contact pressure at the tips of the fibers. By ensuring that the polymeric binder is softer or less stiff than the fibers, the contact pressure between the work piece and the polishing device can be maximized at the fiber tips. As the polishing device presses against the work piece during use, the softer regions of binder surrounding the fibers compress or deflect more readily, thus increasing the contact pressure at the fiber tips as compared to a device having a binder of the same stiffness as the fibers.

In one aspect, the stiffness of a polymeric material may be quantified using a measurement such as Young's Modulus. The Young's Modulus of a polymer or copolymer is readily available to one of ordinary skill in the art, and as such, specific values for polymeric materials will not be given herein. In general, however, a material having a higher Young's Modulus is stiffer than a material having a lower Young's Modulus.

A variety of polymeric materials may be utilized to construct the fibers according to aspects of the present invention. Such materials may be homopolymers or copolymers of numerous known polymeric compounds. The specific material or materials used may vary depending on the nature of the polishing procedure and the configuration and physical and chemical makeup of the work piece. Different polymeric materials may also be utilized when polishing the same work piece depending on a temporal polishing sequence. In other words, a work piece may require polishing that characteristically varies over time. For example, the work piece may require a more aggressive polishing early on and a more delicate polishing at a later time. By selecting materials having different stiffness characteristics, polishing devices may be constructed that provide polishing variation. In one aspect, for example, non-limiting examples of potential polymeric materials useful in constructing polymeric fibers may include polyphenols, polyurethanes, polyamides, aromatic polyamides, polycarbamides, polycarbonates, polyimides, polyphenylene sulfides, polyesters, epoxies, celluloses, polyvinylchlorides, polyvinyl alcohols, nylons, polypropylenes, acrylics, polyethylenes, and combinations and copolymers thereof. In one specific aspect, the polymeric fibers may be made from a polyamide. In another aspect, the polymeric fibers may be made from a polyvinyl alcohol.

The polymeric fibers may be solid polymeric material, or they may be porous in nature. In addition, the polymeric fibers may include nano-abrasive particles impregnated therein. The nano-abrasive particles may assist in the polishing of the work-piece with or without a chemical slurry. In some aspects, nano-abrasive impregnated polymeric fibers can be used to polish a work piece in the absence of a slurry. Although any known nano-abrasive material may be incorporated into the fibers, non-limiting examples of nano-abrasive particles may include diamond, cBN, SiC, $Al_2O_3$, $CeO_2$, $MnO_2$, $ZrO_2$, granet, $SiO_2$, glass, $Fe_2O_3$, $Si_3N_4$, $B_4C$, carbon nano tubes, Bucky balls, and combinations thereof. Such materials may be amorphous, polycrystalline, substantially single crystalline, etc. In one specific aspect, for example, the nano-abrasive particles may be nanodiamond particles, including natural diamond, synthetic diamond, and polycrystalline diamond (PCD). In yet another aspect, the nano-abrasive particles may include cBN, either single crystals or polycrystalline. In yet another specific aspect, the nano-abrasive particles may include alumina.

In addition to nano-abrasives, in another aspect conductive materials or particles may be included in the polymeric fibers to increase the conductivity of the polishing device. Some polishing processes may derive benefit from the inclusion of conductive materials into the polishing device that results in electrochemical polishing in conjunction with the mechanical polishing. In this electrochemical mechanical polishing (ECMP) system conductive particles are removed from a surface to be polished via electrochemical dissolution coupled with mechanical polishing. Because of this electrical element, polishing processes methods requires less mechanical or forced abrasion. ECMP, therefore, can be used to polish surfaces that are more susceptible to deforming, breaking and cracking when using traditional mechanical and/or chemical methods alone. Additionally, ECMP can allow for a very fine polish—particularly with delicate surfaces, such as those that include copper circuitry.

Conductive materials useful in aspects of the present invention may include any known conductive materials, including without limitation, metals, metal alloys, graphite materials, ceramics, etc. In one specific aspect, for example, the conductive material or particles may include a conductive graphite material.

A variety of polymeric materials may be utilized as polymeric binders according to aspects of the present invention. The binder materials may be any polymeric material that is capable of retaining the polymeric fibers in a position to perform a polishing procedure. Such materials may be homopolymers or copolymers of numerous known polymeric compounds. The specific material or materials used may vary depending on the nature of the polishing procedure, the configuration and physical and chemical makeup of the work piece, and the makeup of the polymeric fibers. As has been described, it is important to select the polymeric binder to have a stiffness that is less than the stiffness of the polymeric fibers. As such any known polymeric binder material should be considered to be within the scope of the present invention. Non-limiting examples may include polyethylenes, polyvinyl chlorides, polyvinyl fluorides, polyphenols, polypropylenes, polystyrenes, acrylics, polyurethanes, polyether urethanes, polyester, polycarbonates, polysilicones, polyacrylates, polymethelmethacrylate, polyaramides, celluloses, epoxies, polybutadienes, polyisoprenes, polychloroprenes, isobutenes, and combinations and copolymers thereof. In one specific aspect, the polymeric binder may include a polyphenol. The curing of the polymeric binder materials is dependent on the type of material utilized, and may encompass such methods as heating, chemical reaction, UV radiation, etc. As such curing methods are well known to those of ordinary skill in the art, they will not be discussed in detail.

Numerous additives may be included in the polymeric materials of the fibers and binders to facilitate their use. For example, crosslinking agents and fillers may be used to improve the cured characteristics of the polymeric binder. Additionally, solvents may be utilized to alter the characteristics of a polymeric material in the uncured state. Also, a reinforcing material may be disposed within at least a portion of a polymeric material. Such reinforcing material may function to increase the strength of the polymer, and thus further improve the polishing characteristics of the device. In one aspect, the reinforcing material may include ceramics, metals, or combinations thereof. Examples of ceramics include alumina, aluminum carbide, silica, silicon carbide, zirconia, zirconium carbide, and mixtures thereof.

The cured polymeric binder may be configured to have a variety of physical characteristics. For example, the polymeric binder may be solid or porous, depending on the desired polishing characteristics of the device. Additionally, conductive materials or particles may be impregnated in the polymeric binder to increase the conductivity of the polishing device, as has been described for the polymeric fibers.

The present invention also provides methods of making polishing devices according to aspects of the present invention. For example, in one aspect a method of making a polymeric fiber chemical mechanical polishing device may include selecting a plurality of polymeric fibers having a diameter corresponding to a desired contact pressure, arranging the plurality of polymeric fibers longitudinally such that an average spacing between individual polymeric fibers corresponds to a desired polishing rate, impregnating the plurality of polymeric fibers with an uncured polymeric binder, curing the polymeric binder to secure together the polymeric fibers, and truing a surface of the plurality of polymeric fibers perpendicular to the axis of the polymeric fibers. The polymeric fibers may be spaced in the binder as solitary fibers, or they may be bundled together and spaced in the binder as bundles. In such aspects, the fibers may be woven or twisted together to form a variety of fiber structures, depending on the desired configuration of the polishing device.

A variety of methods for determining the spacing between the polymeric fibers is contemplated, and any method of producing such a spacing would be considered to be within the scope of the present invention. In one aspect, however, the spacing may be a result of the diameter of the polymeric fiber. In other words, polymeric fibers may be bundled together such that each fiber is in contact with adjacent fibers. In this configuration, the spacing between the fibers would be equal to the fiber diameter. Once bundled in such an orientation, a polymeric binder can be infiltrated into the bundle and cured to form a polishing device.

Figure 3:
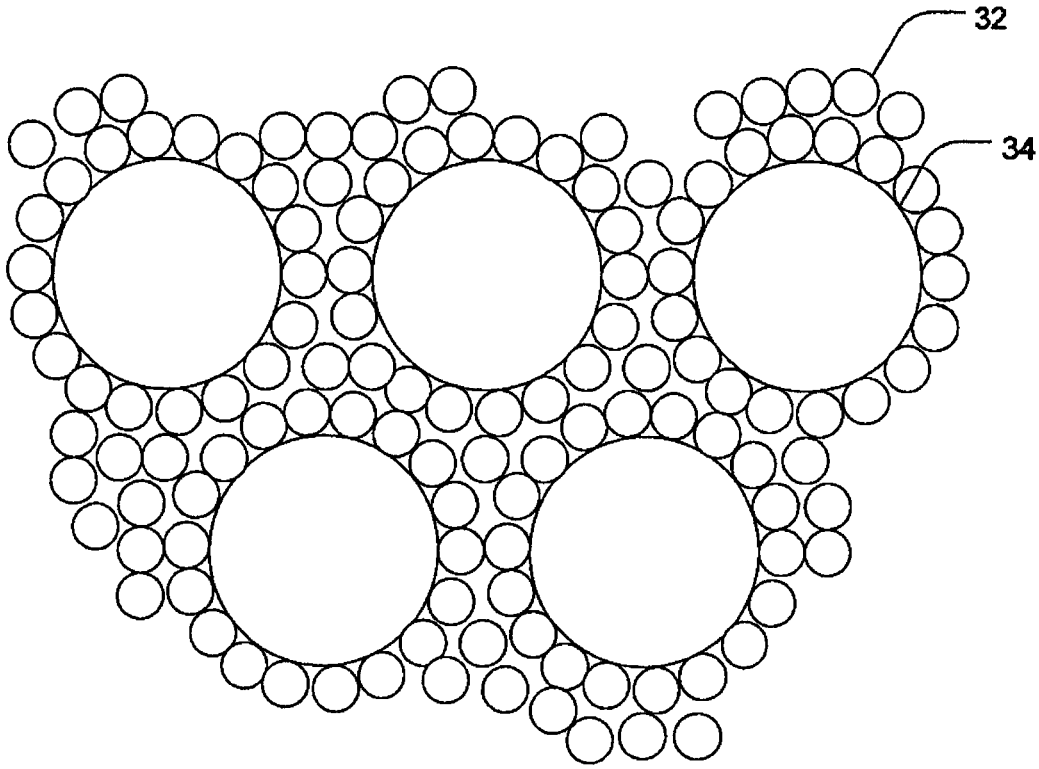
FIG. 3 is a perspective view of a section of a polishing device in accordance with one embodiment of the present invention.

It may be beneficial, however, to produce a polishing device having a polymeric fiber spacing that is greater than the fiber diameter, particularly due to the dependence of polishing rate on fiber spacing. In addition to polishing rate, fibers spaced further apart may allow more deflection of the polymeric binder therebetween, thus further affecting the polishing characteristics of the polishing device. In order to achieve spacing that is greater than the fiber diameter, a spacing material may be utilized. Such a spacing material may be the polymeric binder material itself, or it may be a different material. For example, in one aspect, the spacing material may be the polymeric binder material prior to curing. As is shown in FIG. 3, the uncured polymeric binder material may be formed as a spacing fiber 32. Such spacing fibers 32 may be dispersed amongst the polymeric fibers 34 to create a bundle having a particular spacing between the polymeric fibers 34. The spacing fibers 32 can then be cured by heating or other curing methods to form a polishing device having a fixed spacing between the polymeric fibers 34. It should also be noted that the polymeric fibers 34 may be bundles of polymeric fibers. Additionally, the spacing fibers and the polymeric fibers may be twisted or woven together.

Various methods of arranging the spacing fibers 32 amongst the polymeric fibers 34 are contemplated, and a particular method used may vary depending on the desired uniformity of the spacing. In one aspect, for example, the spacing fibers and the polymeric fibers may be mixed in a particular ratio to achieve an approximate spacing. In another aspect, a single layer of spacing fibers may be fixed around the periphery of the polymeric fibers, and these layered fibers can then be bundled together to produce a uniform spacing. In one aspect, the layer of spacing fibers can be fixed to the polymeric fibers by applying an adhesive to the periphery of the polymeric fibers and then contacting the polymeric fibers with the spacing fibers. Following adherence of the spacing fibers to the polymeric fibers, the newly layered fibers can be separated from the loose spacing fibers and subsequently bundled together. In another aspect, instead of an adhesive layer, the polymeric fibers can be heated slightly to create a tacky outer surface.

In addition to fixing the spacing fibers to the surface of the polymeric fibers, in another aspect the two types of fibers can be woven together in a manner similar to textile weaving. In this way, fibers can be spaced at uniform distances that are greater than can be easily achieved using the layer fiber process. Additionally, multiple fiber types can be woven together with a high degree of spatial specificity. Furthermore, a weaving process allows irregularities to be woven between the polymeric fibers to create porosity in the polymeric binder following curing.

Following the curing of the polymeric binder, a surface perpendicular to the longitudinal axis of the fibers is then trued to form a working surface. Such a truing operation exposes the tips of the polymeric fibers to thus allow contact with the work piece. Truing may be accomplished by any means known, including planning, cutting, grinding, shaving, etc. In one aspect, the working surface may be trued in a flat configuration. In another aspect, the working surface may be trued in a non-level configuration. Examples of such configurations include sloping surfaces, convex surfaces, concave surfaces, irregular surfaces, etc.

Following truing of the polishing device, the end of the tool opposite the trued surface may be configured for coupling to a machine or device that provides motion to the polishing device in order to perform a polishing procedure. Such configuring may include shaping the polymeric binder to correspond to an attachment coupling of the machine, or it may include attaching a support structure to the polishing device that is configured to couple to the machine.

Following truing of the polishing device, a portion of the polymeric binder can be removed to more fully expose the tips of the polymeric fibers. Care should be taken, however, to carefully control the amount of polymeric binder removed such that the polymeric fibers remain supported within the binder and that only their tips will contact the work piece. If too much binder is removed, the fibers will begin to bend during polishing, thus contacting the sides of the fibers against the work piece.

The present invention additionally provides methods of using polishing devices according to aspects of the present invention. For example, in one aspect a method of using a polymeric fiber chemical mechanical polishing device may include contacting tips of a plurality of longitudinally arranged polymeric fibers against a work piece, where the plurality of polymeric fibers have an average parallel spacing corresponding to a desired polishing rate, and moving the plurality of longitudinally arranged polymeric fibers tangentially across a polishing surface of the work piece such that only the tips of the polymeric fibers contact the polishing surface. As has been described, the polishing tool can be used with or without a chemical and/or abrasive slurry.

The following examples present various methods for making the polymeric polishing tools according to aspects of the present invention. Such examples are illustrative only, and no limitation on present invention is meant thereby.

EXAMPLES

Example 1

Polymeric Fiber Formation

Nanodiamond particles having a size of about 4-10 nm are heat treated in a vacuum to carbonize the nanodiamond surface. The nanodiamond particles are dispersed at about 5 V % in a liquid pool of phenolic resin. The nanodiamond impregnated resin is extruded through openings and cured to form polymeric fibers of about 10 microns in size containing nanodiamond particles.

Example 2

Polymeric Fiber Bundling

The polymeric fibers of Example 1 are coated coaxially with an acrylic binder. 7 of the fibers are twisted together to form a thread, and 7 of the threads are twisted together to form a rope, and 7 of the ropes are twisted together to form a cable. The cables are sliced perpendicular to the longitudinal axis to form disks of about 3 mm thick.

Example 3

Formation, Mounting, and Use of the Pad

The disks of Example 2 are packed on a flat mold and a polymeric sheet is applied to the exposed portions of the disks. The polymeric sheet is melted and allowed to infiltrate the disks to form a continuous pad of about 31 inches in diameter. The pad is coated with adhesive and bonded to a SUBA® sub pad. The pad is then mounted on a rotating platen. A miller made of PCD sharp edges is used to true the pad top. The exposed fibers sticking out from the pad to become the polishing medium. Acetone may be added during the polishing process to slowly dissolve the polymeric fibers to expose the impregnated nanodiamond particles. A water jet may be sprayed from time to time to clean the swarf from the polishing surface of the pad. The miller can additionally be used from time to time to resurface the pad top.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A chemical mechanical polishing device, comprising:

a plurality of polymeric fibers longitudinally arranged and embedded in a polymeric binder, the polymeric binder having a Young's Modulus that is less than a Young's Modulus of the polymeric fibers, wherein the polymeric fibers are impregnated with abrasive nanodiamond particles; and a working end of the plurality of polymeric fibers configured such that tips of the polymeric fibers are oriented to contact a work piece.

2. The device of claim 1, wherein the polymeric fibers are arranged in the polymeric binder with a center-to-center spacing of from about 2 times the diameter of the polymeric fibers to about 10 times the diameter of the polymeric fibers.

3. The device of claim 1, wherein the polymeric fibers are arranged in the polymeric binder with a center-to-center spacing from about 3 times the diameter of the polymeric fibers to about 8 times the diameter of the polymeric fibers.

4. The device of claim 1, wherein the polymeric fibers are arranged in the polymeric binder with a center-to-center spacing of from about 4 times the diameter of the polymeric fibers to about 6 times the diameter of the polymeric fibers.

5. The device of claim 1, wherein the polymeric fibers have a diameter of from about 2 microns to about 50 microns.

6. The device of claim 1, wherein the polymeric fibers have a diameter of from about 5 microns to about 20 microns.

7. The device of claim 1, wherein the tips of the polymeric fibers protrude from the polymeric binder at the working end to a distance of less than about 20 microns.

8. The device of claim 1, wherein the tips of the polymeric fibers protrude from the polymeric binder at the working end to a distance of less than about 10 microns.

9. The device of claim 1, wherein the polymeric fibers include a member selected from the group consisting of polyphenols, polyurethanes, polyamides, aromatic polyamides, polycarbamides, polycarbonates, polyimides, polyphenylene sulfides, polyesters, epoxies, celluloses, polyvinylchorides, polyvinyl alcohols, nylons, polypropylenes, acrylics, polyethylenes, and combinations and copolymers thereof.

10. The device of claim 1, wherein the polymeric binder includes a member selected from the group consisting of polyethylenes, polyvinyl chlorides, polyvinyl fluorides, polyphenols, polypropylenes, polystyrenes, acrylics, polyurethanes, polyether urethanes, polyester, polycarbonates, polysilicones, polyacrylates, polymethelmethacrylate, polyaramides, celluloses, epoxies, polybutadienes, polyisoprenes, polychloroprenes, isobutenes, and combinations and copolymers thereof.

11. The device of claim 10, wherein the polymeric binder includes a polyphenol.

12. The device of claim 1, further comprising conductive particles impregnated within the polymeric fibers and/or the polymeric binder.

13. The device of claim 12, wherein the conductive particles include a conductive graphite material.

14. The device of claim 1, wherein the polymeric binder is porous.

15. The device of claim 1, further comprising at least one polymeric spacing fiber contacting at least a portion of the plurality of polymeric fibers to provide spacing between the plurality of polymeric fibers.

16. The device of claim 1, wherein the plurality of polymeric fibers is a plurality of bundles of polymeric fibers.

* * * * *